United States Patent [19]

Kurosaki

[11] Patent Number: 4,903,569

[45] Date of Patent: Feb. 27, 1990

[54] DRUM LUG

[75] Inventor: Makoto Kurosaki, Hamamatsu, Japan

[73] Assignee: Yamaha Corporation, Hamamatsu, Japan

[21] Appl. No.: 352,261

[22] Filed: May 16, 1989

[30] Foreign Application Priority Data

May 17, 1988 [JP] Japan ..... 63-63949[U]

[51] Int. Cl.[4] ..... G10D 13/02

[52] U.S. Cl. ..... 84/413; 84/411 R; 411/427

[58] Field of Search ..... 84/411 R, 413

[56] References Cited

U.S. PATENT DOCUMENTS 4,122,747 10/1978 Toshinori ..... 84/411 R

*Primary Examiner*—Lawrence R. Franklin

*Attorney, Agent, or Firm*—Burns, Doane, Swecker & Mathis

[57] ABSTRACT

A drum lug includes a lug case and a lug nut. The lug case is fixed to an outer surface of a drum body. A threaded hole with which the lug bolt is threadably engaged is formed in the center of the lug nut. The lug nut is housed in the lug case with one end portion of the lug nut being exposed outside the lug case. A spot-faced hole communicating with the threaded hole is formed in the center of an outer end face of the lug nut in a predetermined depth. The hole diameter of the spot-faced hole is set to be slightly larger than the major diameter of the threaded hole.

2 Claims, 1 Drawing Sheet

DRUM LUG

BACKGROUND OF THE INVENTION

The present invention relates to a drum lug for tensioning and supporting a drum head and, more particularly, to a drum lug which is designed to improve operability upon detachment thereof and durability of a lug nut.

A conventional head tension lug used for percussion such as a drum has an arrangement shown in FIG. 3. More specifically, reference numeral 1 denotes a drum body. A plurality (e.g., 6 to 10) of lug cases 2 are fastened to the outer surface of the drum body 1 with threads. A lug nut 4 whose one end is exposed from a through hole 3 formed in each lug case 2 and a spring 5 for biasing the lug nut 4 in a direction to extend outward are housed in the lug case 2. A lug is constituted by these components. The lug nut 4 is formed into a cylindrical shape, and a collar 4*a* for preventing slipping off of the lug nut 4 is integrally formed therewith. A threaded hole 7 in which a lug bolt 6 is screwed is formed at the center of the lug nut 4.

A drum head 10 whose peripheral portion is supported by a head frame 9 is tensioned at an opening end 8 of the drum body 1. A clamp frame 11 formed around the periphery of the drum head 10 and the lug nut 4 are coupled to each other with the lug bolt 6. The clamp frame 11 is urged against the head frame 9 by a clamping operation of the bolt 6, thereby providing a predetermined tension to the drum head 10.

The threaded hole 7 of the lug nut 4 of this conventional type is formed along the entire length of the nut 4, and is open at external end faces 12*a* and 12*b*. With this arrangement, when the lug bolt 6 is loosened by a tuning key upon replacement of the drum head 10 and is pulled out from the threaded hole 7, the lug nut 4 and the lug bolt 6 are completely separated from each other. As a result, the lug bolt 6 tends to totter and move in the axial direction, and the tuning key is easily slipped off from the head of the lug bolt 6. In contrast to this, when a new drum head 10 is to be tensioned on the drum body 1 by screwing the lug bolt 6 into the threaded hole 7 of the lug nut 4, if the axes of the lug bolt 6 and the threaded hole 7 are not aligned with each other and the lug bolt 6 is forcibly screwed into the threaded hole 7 at an improper angle, seizing of the threads may occur or the thread ridges may be flattened. Therefore, in order to prevent such a situation, it is preferable that the lug bolt 6 is manually aligned with and slightly screwed into the threaded hole 7 of the lug nut 4 in advance, and is then fastened by the tuning key. Such an operation is time-consuming and cumbersome, and hence is not frequently performed in practice. Therefore, the service life of the lug nut 4 is inevitably shortened.

SUMMARY OF THE INVENTION

It is a principal object of the present invention to provide a drum lug capable of performing a fastening operation of a lug bolt to a lug nut within a short period of time.

It is another object of the present invention to provide a drum lug capable of minimizing the occurrence of seizing of a lug bolt and a lug nut and of flattening of thread ridges when the lug bolt is fastened to the lug nut, and improving their durability.

It is still another object of the present invention to provide a drum lug capable of stably holding a lug bolt even if the lug bolt is pulled out from a threaded hole of a lug nut, and preventing tottering of the bolt, slipping off of a tuning key, and the like.

In order to achieve the above objects, according to the present invention, there is provided a drum lug comprising a lug case fixed to an outer surface of a drum body, and a lug nut having a threaded hole which is formed in a center thereof and with which the lug bolt is threadably engaged the lug nut being housed in the lug case with one end portion of the lug nut being exposed outside the lug case, wherein a spot-faced hole communicating with the threaded hole is formed in a center of an outer end face of the lug nut in a predetermined depth, and a hole diameter of the spot-faced hole is set to be slightly larger than a major diameter of the threaded hole.

According to the present invention, since the lug bolt is threadably engaged with the threaded hole through the spot-faced hole of the lug nut, even if the lug bolt is loosened and pulled from the threaded hole, the lug bolt is not yet pulled out from the lug nut. Therefore, the lug bolt is not tottered. In addition, since the spot-faced hole has a hole diameter slightly larger than the major diameter of the threaded hole, the axes of the lug bolt and the threaded hole are aligned with each other without a manual operation when the lug bolt is to be fastened to the lug nut. Therefore, the lug bolt can naturally be threadably engaged with the threaded hole smoothly by simply rotating the lug bolt.

DETAILED DESCRIPTION OF THE PREFERRED EMBODIMENT

An embodiment of the present invention will be described in detail below with reference to the accompanying drawings.

Figure 3:
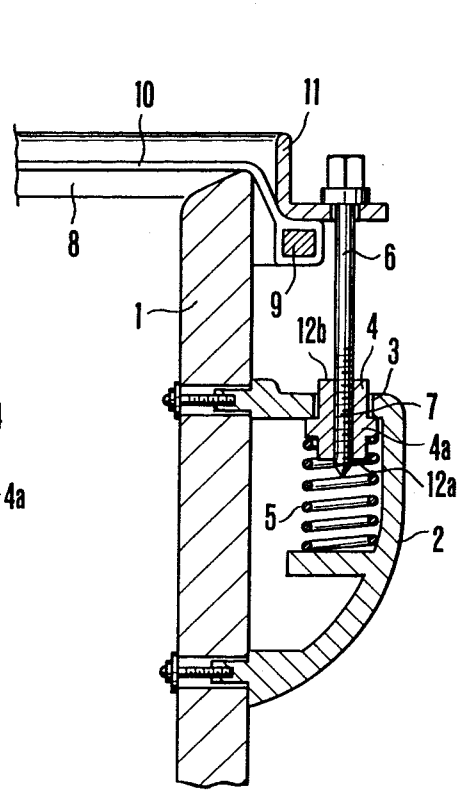
FIG.3 PRIOR ART
FIG. 3 is a sectional view showing a conventional drum lug.
Figure 2:
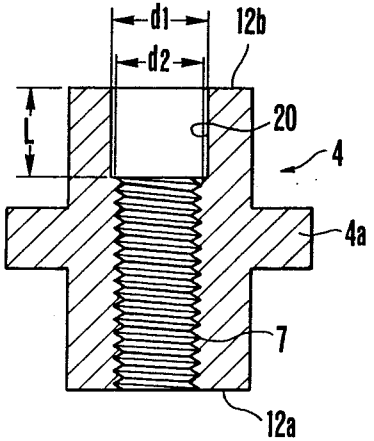
FIG. 2 is a sectional view showing a lug nut.
Figure 1:
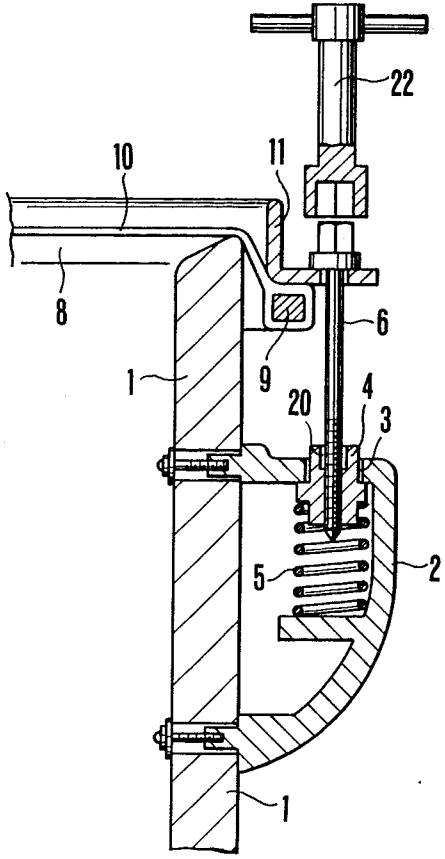
FIG. 1 is a sectional view showing an embodiment of the present invention.

FIG. 1 shows a drum lug according to an embodiment of the present invention. FIG. 2 is a sectional view of a lug nut. Note that the same reference numerals in FIGS. 1 and 2 denote the same parts as in FIG. 3, and a description thereof will be omitted. Referring to FIGS. 1 and 2, in this drum lug, a spot-faced hole 20 communicating with a threaded hole 7 with which a lug bolt 6 is threadably engaged is formed at the center of an outer end face of a lug nut 4, i.e., an end face 12*b* exposed outward from a lug case 2. A hole diameter $d_1$ of the spot-faced hole 20 is set to be slightly larger than a major diameter $d_2$ of the threaded hole 7 ($d_1 > d_2$). A depth L of the spot-faced hole 20 is set to be a value enough to support the distal end portion of the bolt 6 when it is pulled from the threaded hole 7.

According to the drum lug having such an arrangement, even if the lug bolt 6 is loosened by a tuning key and pulled from the threaded hole 7, the distal end portion of the bolt 6 is still placed and rotated inside the spot-faced hole 20, and is not completely pulled out therefrom. Since the bolt 6 does not totter in this state and is stable set at a predetermined position, the tuning key is not slipped off from the head of the bolt 6. In addition, if the lug bolt 6 is rotated while its distal end portion is inserted in the spot-faced hole 20 during a fastening operation of the bolt 6, since the bolt 6 is guided by the spot-faced hole 20, it can be threadably engaged with the threaded hole 7 smoothly. Therefore, seizing of the thread ridges of the lug bolt 6 and the threaded hole 7 or flattening thereof can be prevented. In addition, the lug bolt 6 need not be slightly manually screwed into the threaded hole 7 in advance, and hence a fastening operation can be performed within a short period of time. That is, since the hole diameter $d_1$ of the spot-faced hole 20 is set to be slightly larger than the major diameter $d_2$ of the threaded hole 7, the axes of the lug bolt 6 and the threaded hole 7 can be easily aligned with each other, and the lug bolt 6 can be threadably engaged with the threaded hole 7 without causing any trouble.

A hard lubricatant such as grease is normally coated on both or either of the lug nut 4 and the lug bolt 6 in order to prevent seizing thereof. In the conventional structure shown in FIG. 3, since most of grease is applied to the distal end portion of the lug nut 4 or protrudes near the opening of the threaded hole of the lug nut 4, the grease cannot satisfactorily function. However, in the drum lug of the present invention, the spot-faced hole 20 also serves as a reservoir for grease so as to prevent the outer end face **12*b* of the lug nut 4 from being contaminated and sticky due to the grease. In addition, this structure is effective in minimizing the occurrence of contamination of the respective portions of the drum due to the grease applied to the distal end portion of the lug bolt 6**.

Note that a spot-faced hole may be tapered downward toward its bottom portion. In this embodiment, a drum head is exemplified. However, the present invention can be applied to a case wherein drum heads are arranged on the upper and lower surfaces of a drum body.

As has been described above, according to the drum lug, since a spot-faced hole communicating a threaded hole is formed in an outer end face of a lug nut, even if a lug bolt is pulled from the threaded hole of the lug nut, since the distal end portion of the bolt is stably held in the spot-faced hole, the bolt does not totter. Hence, a tuning key is not slipped off from the lug bolt. In addition, since the hole diameter of the spot-faced hole is set to be slightly larger than the major diameter of the threaded hole, when the lug bolt is to be threadably engaged with the threaded hole, their axes can be easily aligned with each other, and they can be threadably engaged with each other without causing any problem. A fastening operation can be performed within a short period of time, and the occurrence of seizing of the lug bolt and the lug nut and of flattening of the thread ridges can be minimized, thereby improving durability of the lug bolt as well as the lug nut. Moreover, the spot-faced hole is advantageous in practical use, e.g., serving as a reservoir for a lubricatant.

What is claimed is:

1. A drum lug comprising:

a lug case fixed to an outer surface of a drum body; and a lug nut having a threaded hole which is formed in a center thereof and with which said lug bolt is threadably engaged, said lug nut being housed in said lug case with one end portion of said lug nut being exposed outside said lug case, wherein a spot-faced hole communicating with said threaded hole is formed in a center of an outer end face of said lug nut in a predetermined depth, and a hole diameter of said spot-faced hole is set to be slightly larger than a major diameter of said threaded hole.

2. A lug according to claim 1, wherein said one end portion of said lug nut protrudes from said hole formed in said lug case, and said lug nut is biased by a spring in the direction to protrude.

* * * * *